US007832976B2

(12) United States Patent
Miglioranza

(10) Patent No.: US 7,832,976 B2
(45) Date of Patent: Nov. 16, 2010

(54) METHOD AND APPARATUS FOR THE AUTOMATIC FEEDING OF METAL SECTION BARS

(75) Inventor: Aronne Miglioranza, Padernello Di Paese (IT)

(73) Assignee: Schnell S.p.A., Montemaggiore (IT)

( * ) Notice: Subject to any disclaimer, the term of this patent is extended or adjusted under 35 U.S.C. 154(b) by 326 days.

(21) Appl. No.: 12/089,935

(22) PCT Filed: Oct. 9, 2006

(86) PCT No.: PCT/IT2006/000719

§ 371 (c)(1),
(2), (4) Date: Apr. 11, 2008

(87) PCT Pub. No.: WO2007/043089

PCT Pub. Date: Apr. 19, 2007

(65) Prior Publication Data

US 2008/0247849 A1 Oct. 9, 2008

(30) Foreign Application Priority Data

Oct. 14, 2005 (IT) ..... B005A0615

(51) Int. Cl.
*B66F 11/00* (2006.01)

(52) U.S. Cl. ..... 414/745.1; 414/801

(58) Field of Classification Search ..... 198/396; 209/521; 414/745.1, 745.7, 745.9, 746.4, 414/933

See application file for complete search history.

(56) References Cited

U.S. PATENT DOCUMENTS

| | | | | |
|---|---|---|---|---|
| 4,548,537 | A | 10/1985 | Kubotera et al. | |
| 4,732,066 | A * | 3/1988 | Del Fabro et al. | 83/277 |
| 4,820,101 | A * | 4/1989 | Fenn | 414/21 |
| 2003/0201149 | A1 * | 10/2003 | Miglioranza | 198/369.1 |
| 2003/0202873 | A1 | 10/2003 | Miglioranza | |
| 2005/0106000 | A1 * | 5/2005 | Hogue et al. | 414/794.3 |
| 2009/0191041 | A1 * | 7/2009 | Del Fabro et al. | 414/745.1 |

FOREIGN PATENT DOCUMENTS

| | | |
|---|---|---|
| EP | 0 790 086 | 8/1997 |
| EP | 790086 A2 * | 8/1997 |
| IT | BO2002A0000241 | 4/2002 |
| IT | BO2003A000039 | 1/2003 |
| IT | 2004UD00012 | 1/2004 |
| WO | WO 2005/080021 | 9/2005 |

* cited by examiner

*Primary Examiner*—Gregory W Adams
(74) *Attorney, Agent, or Firm*—McGlew and Tuttle, P.C.

(57) ABSTRACT

The method for the automatic feeding of metal section bars provides for seizing a group of metal section bars (2) from a store (3) by means of gripping tools (11) and for transferring the said group of metal section bars (2) in a lifted position. The metal section bars (2) are arranged on a transfer device (20) suited to transfer the metal section bars (2) on receiving means (30). In a suitable phase relationship, the counting of the metal section bars (2) transferred on the said receiving means (30) is carried out. Such operating cycle is repeated until a prefixed number of metal section bars (2) is reached. The whole of the metal section bars (2) is disentangled through the progressive sliding of the receiving means (30) along the longitudinal axis of the metal section bars (2).

25 Claims, 12 Drawing Sheets

METHOD AND APPARATUS FOR THE AUTOMATIC FEEDING OF METAL SECTION BARS

TECHNICAL FIELD

The present invention relates to a method and an apparatus for the automatic feeding of metal section bars, in particular iron rods for reinforced concrete, in plants intended for the manufacturing of such section bars and the like.

BACKGROUND ART

It is well known that iron elements used, for instance, for manufacturing reinforcements for reinforced concrete can be obtained from bar-shaped steel rods. To this end, the bars are fed, individually or bunched, to operating machines that automatically manufacture the bars in a series of desired products. The plants intended for manufacturing such metallic section bars are usually provided with a depository, known as ironworks, from which the bars are methodically stored and, little by little, taken and fed to the operating machines or merely moved elsewhere.

Furthermore, it is a necessity to evaluate the correct number of bars to take or to feed to the operating machine depending on the manufacturing requirements, for instance according to the production capacity of the machines, the diameter of the bars, the peculiarities of the processed material, the production requirements.

Several methods and related apparatuses have been proposed for taking and feeding metallic section bars.

The European patent EP 0790086 illustrates a method for the automatic separation of metallic bars. According to this method, metallic bars, packed in a bundle, are repeatedly lowered and lifted, at least near respective ends, in such a way that at least a couple of ends is retained at a lifted position. Detecting instruments of optoelectronic type detect the position of the bars, so that at least a metallic bar can be selected in a suitable position for the subsequent separation. Afterwards, a gripping device is positioned at the end portion of the selected bar in order to operate the locking, the horizontal shifting and eventually the separation from the remaining metallic bars. Subsequently, the singularized bar can be laid on a supporting surface or fed to a successive processing station.

Such a method appears very complicated because it requires the use of sophisticated detecting instruments in order to operate the selection of every metallic bar to separate. Furthermore, the preliminary operations to the selection, particularly the repeated lowering and lifting of the bundle of bars, remarkably extend the production time needed for every separation cycle.

The U.S. Pat. No. 4,548,537 illustrates an apparatus suited to collect one by one different bar-shaped materials initially stored on a shelf. A portion of the bars is separated from the heap by means of collecting means located near the shelf, so as to be seized by vicing means contrasting the collecting means. Afterwards, the bars, retained by the vicing means, are extracted by extracting means and separated from the remaining material stored on the shelf Such an apparatus appears extremely slow, because only a single bar is separated at every cycle performed by the collecting means. Furthermore, it can be used only with very stiff bars, preferably short, or with pipes which are unlikely to get entangled during the storing phase. On the contrary, the apparatus cannot be effectively used with iron rods for reinforced concrete, which, owing to their length, generally variable from 12 to 24 meters, show a considerable flexibility.

The Italian patent application UD2004A000012 shows a separation apparatus including first magnetic tools acting along a first operating direction in order to separate and lift up from the bundle an end portion of a plurality of bars in store, disposing them substantially lined up on a surface. Second magnetic tools, acting along an operating direction substantially perpendicular to the longitudinal profile of the bars, are suited to collect and extract one or more bars at a time.

Apparatuses of such a typology show remarkable limitations because, being suited to seize single bars by only one end portion instead of by the whole length, they are suitable for use solely within machines provided with extracting and drawing means acting on the bars separated from the stored bundles. The patent application BO2002A000241, filed by the Applicant, belongs to such a typology as well.

The patent application BO2003A000039, filed by the Applicant, illustrates a method for feeding metallic section bars, which allows separating the correct number of bars from the bundle to which the separated bars belong, for automatically feeding such bars to the manufacturing plants. The method provides to seize a group of bars from a store of such bars and to transfer the aforesaid group of bars in a lifted position. The lifted bars are placed on a mobile transferring device provided with separation means of the kind of the Archimedean screw, whereat is operated the transversal transfer and the counting of a prearranged number of bars to feed at each cycle to the machine downstream. Such a method, however, causes relatively long operating times in comparison with the present production requirements.

DISCLOSURE OF THE INVENTION

The aim of the present invention is to solve the cited problems by devising a method and an apparatus which allow to effectively operate the automatic feeding of metallic section bars, particularly in plants for manufacturing such section bars or for similar uses.

Within this aim, it is a further scope of the present invention to provide for a method and an apparatus for the automatic feeding of metallic section bars that allow to reduce the operating time, thus increasing productivity.

It is a further scope of the present invention to provide for an apparatus for the automatic feeding of metallic section bars of simple conception, provided with reliable function and versatile use.

The cited aims are achieved according to the present invention by the method for the automatic feeding of metallic section bars, characterized in that it comprises the following phases:

(a). to seize a group of metallic section bars from a store of such section bars, by means of gripping tools acting on one or more sections of such metallic section bars;

(b). to transfer the said group of metallic section bars to a lifted position;

(c). to arrange the said group of metallic section bars on a transfer device suited to operate the separation of the same metallic section bars;

(d). to transfer the said group of metallic section bars on receiving means;

(e). to carry out, in suitable phase relationship, the counting of the said metallic section bars transferred to the said receiving means;

(f). to repeat the said operating cycle until a prearranged number of metallic section bars is reached;

(g). to disentangle with a single operation the totality of the said collected metallic section bars through the progressive sliding of the said receiving means along the longitudinal axis of such metallic section bars;

(h). to transfer and discharge with a single operation the said picked out metallic section bars in a discharge area.

BRIEF DESCRIPTION OF THE DRAWINGS

Description details of the invention shall be further evident in the illustrations of a preferred embodiment of the apparatus for the automatic feeding of metallic section bars, illustrated in the guideline drawings attached, wherein.

BEST MODE FOR CARRYING OUT THE INVENTION

Figure 1:
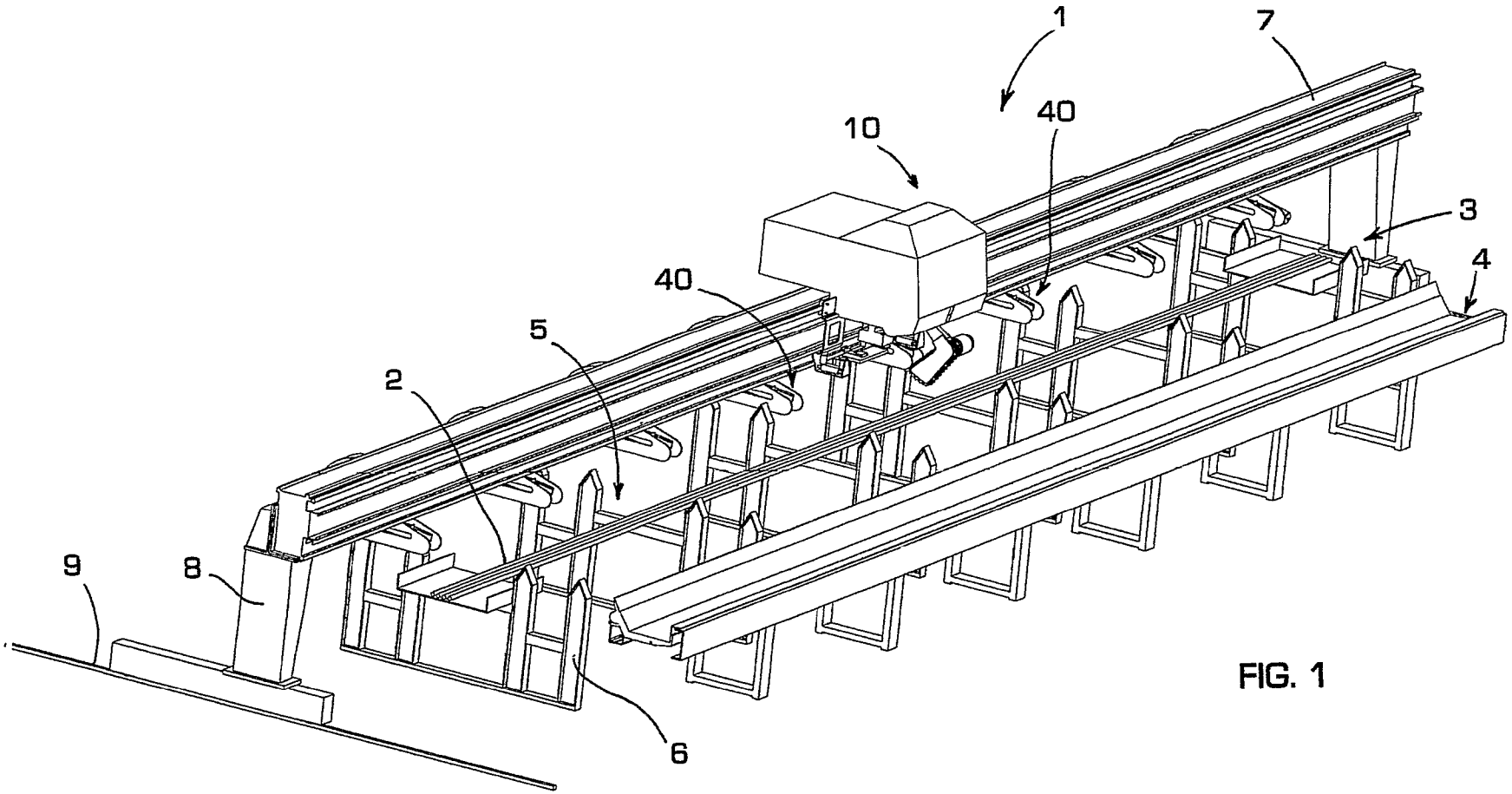
FIG. 1 illustrates a perspective view of the apparatus for the automatic feeding of metallic iron bars.

With reference to such figures, 1 refers to the apparatus for the automatic feeding of metallic section bars 2 in a plant for the manufacturing of such section bars, for instance a plant that automatically performs the cutting, the storage and the handling of the bars. Nevertheless, the apparatus 1 can be suitably used even in plants performing the storage, the transport and/or the fastening of bundles of suitably selected bars, or only for the counting and/or the separation of the bars.

The plant is provided, in a well known way, with a store 3 for the storage of the bars 2 to feed, otherwise known as ironworks, that in the illustrated case is positioned beside an unloading channel 4 usually consisting in a roller surface suited to feed a cutting machine. The store 3 is formed by at least a storage space 5 shaped by a series of trestle stands 6 arranged in series and suitably spaced out.

The apparatus 1 provides for an assembly 10 for collecting and counting the bars 2, supported by a beam-shaped support frame 7 placed as a bridge above the store 3, parallel to the bars 2. The beam-shaped frame 7 is supported, at the opposite ends, by a couple of moving columns 8, driven by not represented movers, on rails 9, so that the collecting and counting assembly 10 is moved above the selected storage space 5 of the store 3 in order to collect the bars 2, and above the unloading channel 4.

The collecting and counting assembly 10 is provided with gripping tools 11 for gripping a group of bars 2 from the above-mentioned storage space 5 of the store 3. The collecting and counting assembly 10 is preferably arranged in a substantially central position as to the beam-shaped frame 7, so the gripping tools 11 catch a part of the bundle of bars 2 at a corresponding substantially central zone of their length, as explained in detail hereafter.

The gripping tools 11 are preferably constituted by one or more permanent magnets 12, in the illustrated case by a couple of magnets, supported in rectilinear motion, along a substantially vertical axis, by a respective not represented actuator constituted, for instance, by a fluid-dynamic cylinder, a winch, a mover coupled with driving tools of the kind of screw-nut screw or rack and the like.

The magnets 12 can otherwise follow a special path, defined by the space occupied by the ironworks or by other constraints. Obviously it is possible to provide for the use of gripping tools of a different kind, for instance constituted by a couple of electromagnets or pliers-shaped tools.

The gripping tools 11 are suited to cooperate with a transfer device 20, placed in a mean position as to the pair of magnets 12. The transfer device 20 is preferably constituted by a tracked tool 21 suited to perform the separation of the single bars 2. Nevertheless, it is possible to provide for the use of transfer means of a different kind, for instance an Archimedean screw or magnetic tools. The tracked tool 21 is driven forward by a mover 22 through specially provided driving means.

In particular, the tracked tool 21 is constituted by a series of segments 24 constrained to a chain tool winding around a series of wheels carried rotating by a frame 27 of the transfer device 20. The chain defines a substantially polygonal path for the tracked tool 21, in which an operative stretch 21 a can be marked, extending between a couple of the above-mentioned wheels, placed horizontally during the active phase. Usefully, it is provided that the segments 24 of the tracked tool 21 are constrained to the chain with differentiated pitches at two or more stretches of the same chain, for the optimal manufacturing of bars of different diameter. For instance, it is possible to provide that the tracked tool 21 is constituted by a first stretch with short pitch and by a second stretch with extended pitch.

The transfer device 20 is mounted oscillating around an axis 23, preferably horizontal, upon control of a specially provided actuator, pivoted on the supporting structure 13 of the collecting and counting assembly 10. In practice, the transfer device 20 is revolving between a lifted substantially horizontal working position and a lowered disengaging position, so that it does not obstruct the way of the bars 2 during the loading movement of bars 2 themselves.

Counting tools 14 for the bars 2, for instance constituted by photocell optic sensors or similar instruments, as micro switches, mechanical or laser instruments or the like, cooperate with the tracked tool 21.

Furthermore, a levelling device 50, placed above the operative stretch 21*a* arranged horizontally during the active phase, is suited to cooperate with the tracked tool 21. The levelling device 50 acts as a limiter of the clearance of the bars 2 in order to avoid counting errors due to undesired overlaps of the bars 2 themselves. The levelling device 50 has an adjustable position, so that the aforesaid clearance can be adjusted depending on the diameter of the bars 2 in process of manufacturing.

Furthermore the collecting and counting assembly 10 provides for tightening tools 15 suited to retain the bars 2 fed by the transfer device 20. The tightening tools 15 are constituted by a clamp formed by a lower sliding jaw 16 and one or more upper mobile jaws 17. The sliding jaw 16 is constrained to the beam-shaped frame 7, whereas the mobile jaw 17 is operated along a vertical axis by a specially provided actuator.

By the sides of the transfer device 20 are positioned receiving means 30 suited to disentangle the bars 2 fed by the transfer device itself. In practice, such receiving means 30 are substantially constituted by one or more shuttles 31, moving along the beam-shaped frame 7. In the illustrated case, it is provided for a couple of shuttles 31 moving in opposing directions, but it is possible to provide for the use of one or more couples of shuttles suited to work in parallel connection or in sequence, lined up or staggered.

The shuttles 31 present a respective carriage 32 provided with rollers 33 engaging a guide shaft 34 longitudinally integral with the beam-shaped frame 7. The carriage 32 is suited to be operated in motion by specially provided movers through chain drives associated with the beam-shaped frame 7. The carriage 32 carries hanging a frame 35, open on the upper side, on which are pivoted, freely rotating, a plurality of vertical rollers 36 and horizontal rollers 37, suited to shape a sort of cradle designed to receive the bars 2 to disentangle, in order to act as a sliding support for the bars 2, thus reducing the friction generated during the manufacturing phases. The shuttles 31 can be provided as well with a device suited to prevent the bars 2, once loaded, from being accidentally discharged.

The shuttles 31 are driven progressively along the longitudinal axis of the beam-shaped frame 7 by the cited movers, in opposite directions, between a receiving position for the bars 2, substantially beside the transfer device 20, and a discharge position for the bars 2, such as to exceed the length of the bars 2 themselves.

Moreover, auxiliary supporting tools 40, suited to support the bars 2 released by the shuttles 31, are provided at prearranged positions, regularly spaced, along the beam-shaped frame 7. The auxiliary supporting devices 40 are constituted by retractable arms 41 suited to be operated by respective linear actuators along an axis substantially transversal to the beam-shaped frame 7. The retractable arms 41 are provided, at their clear end, with a tab 42 protruding upward, suited to retain the bars 2 on the arms themselves. In practice, the retractable arms 41 are suited to be alternately driven between an extracted receiving position of the bars 2; a retracted clearing position, suitable for not interfering with the collecting of the bars 2 and, meanwhile, for supporting the already loaded bars; and a discharge overturned position of the bars 2, as explained in detail hereafter.

In the illustrated embodiment, the retractable arms 41 are guided sliding by a guide frame 43 associated with a couple of opposing walls 44, fixed to the beam-shaped frame 7 on vertical planes transversal to the beam-shaped frame 7. A slot 45 is made on the walls 44, suitably shaped, along which is guided a respective pivot 46, directly constrained to the guide frame 43. In particular, the slots 45 show a substantially horizontal stretch 45*a*, intended for guiding the motion of translation of the retractable arms 41, and a suitably sloped stretch 45*b*, intended for producing a combined upsetting motion for the guide frame 43. The walls 44 show an edge 47 sloped downwards, near the front end, whereon the bars 2 are intended for sliding, during the discharge phase, as explained in detail hereafter.

The method for automatically feeding the bars 2 substantially provides for seizing a group of bars, preferably in the upper position and substantially in the mean part, from a bundle of bars placed in the prearranged store 5 of the store 3 through the magnets 12 of the gripping tools 11 and, at first, transferring such group of bars 2 in a lifted position. It is also possible, but less advantageous, to provide likewise for the apparatus 1 being placed laterally and, thus, for lifting the end of the group of bars 2 instead of the mean part or any portion.

Figure 2:
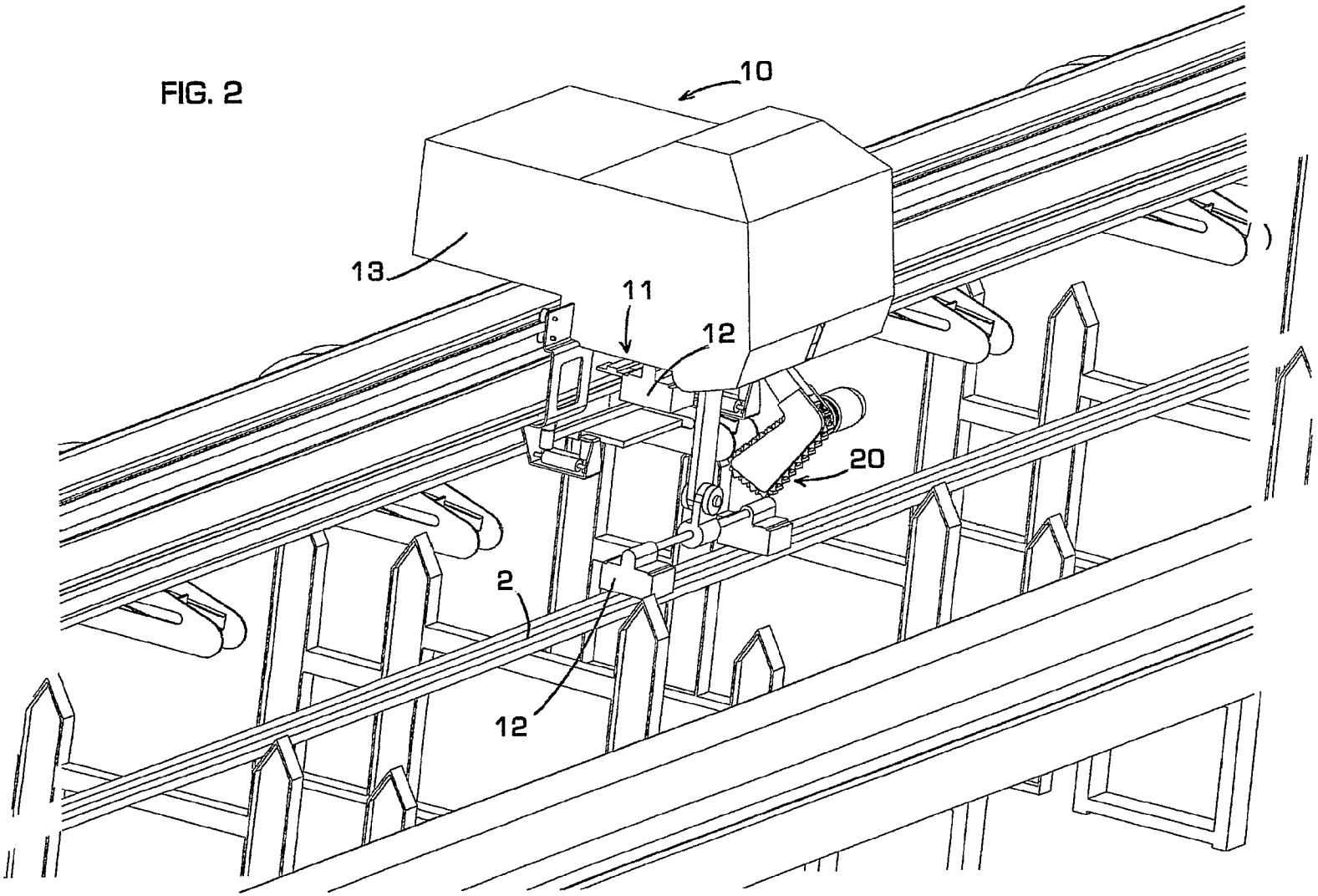
FIGS. 2, 3, 4, 5 and 6 illustrate a perspective view of an operational zone of the apparatus in different operational phases.

In order to realize the seizing, the magnets 12 are simultaneously set in motion from an inactive lifted position to a lowered seizing position against the bundle of bars 2, thus reaching those bars which are lying in the upper part of the bundle, near the store space 5 of the store 3 (FIG. 2). The magnets 12 seize the bars 2 substantially near their central part. It is remarkable that, during the collecting phase of the bars 2, the tracked tool 21 of the transfer device 20 is kept rotated in the lowered position, that is in a configuration that clears the way of the bars 2.

Figure 3:
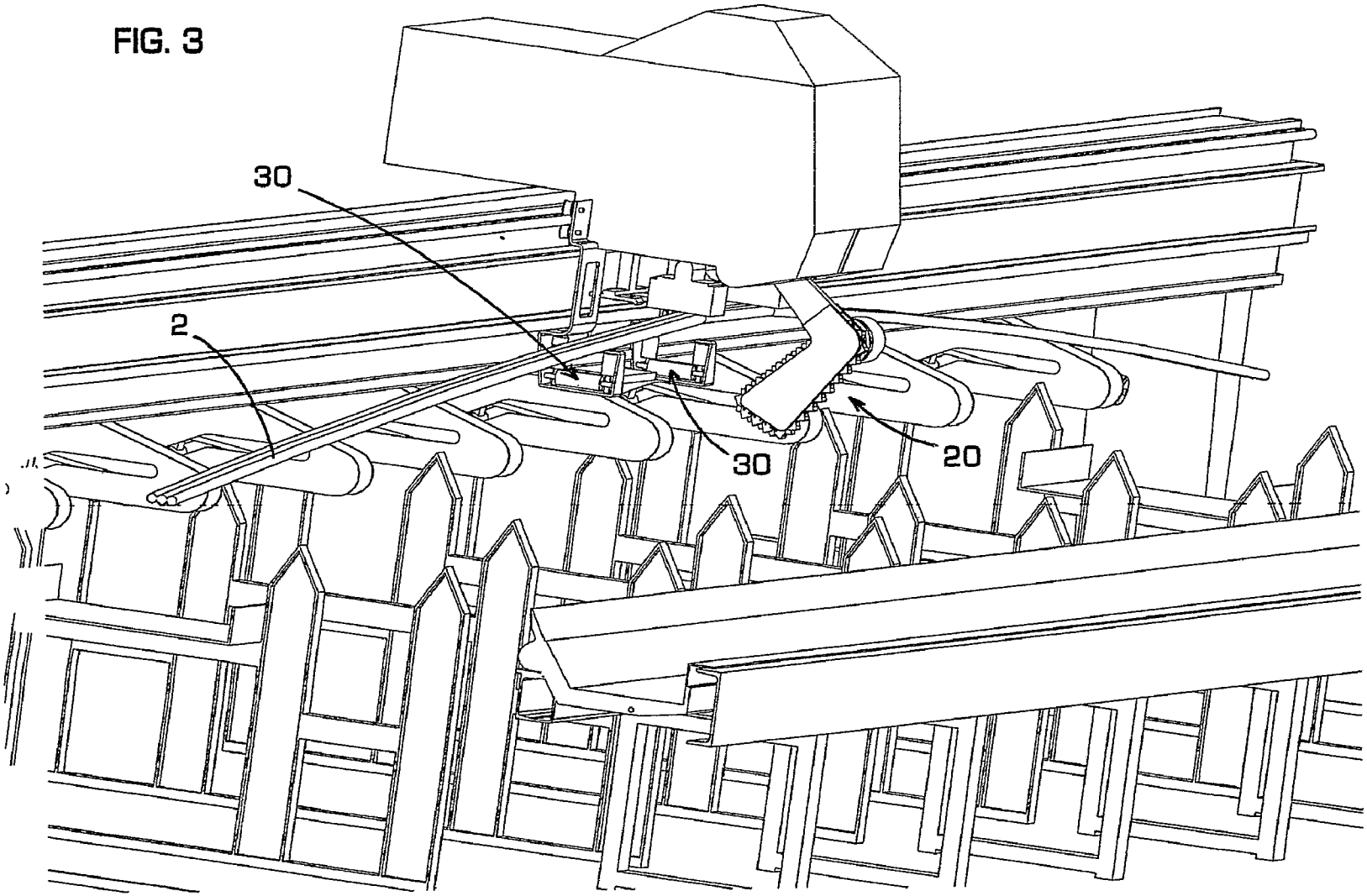

Once executed the seizing of the aforesaid group of bars 2, the gripping magnets 12 are vertically translated in order to take the group of attached bars 2 to a lifted position (FIG. 3).

Being the bars 2 seized by their mean zone, the lifting performed by the magnets 12 causes a bending of the bars 2 themselves. Therefore it is usefully provided that the magnets 12 are carried swinging, through respective articulations, at the respective driving stems.

Figure 4:
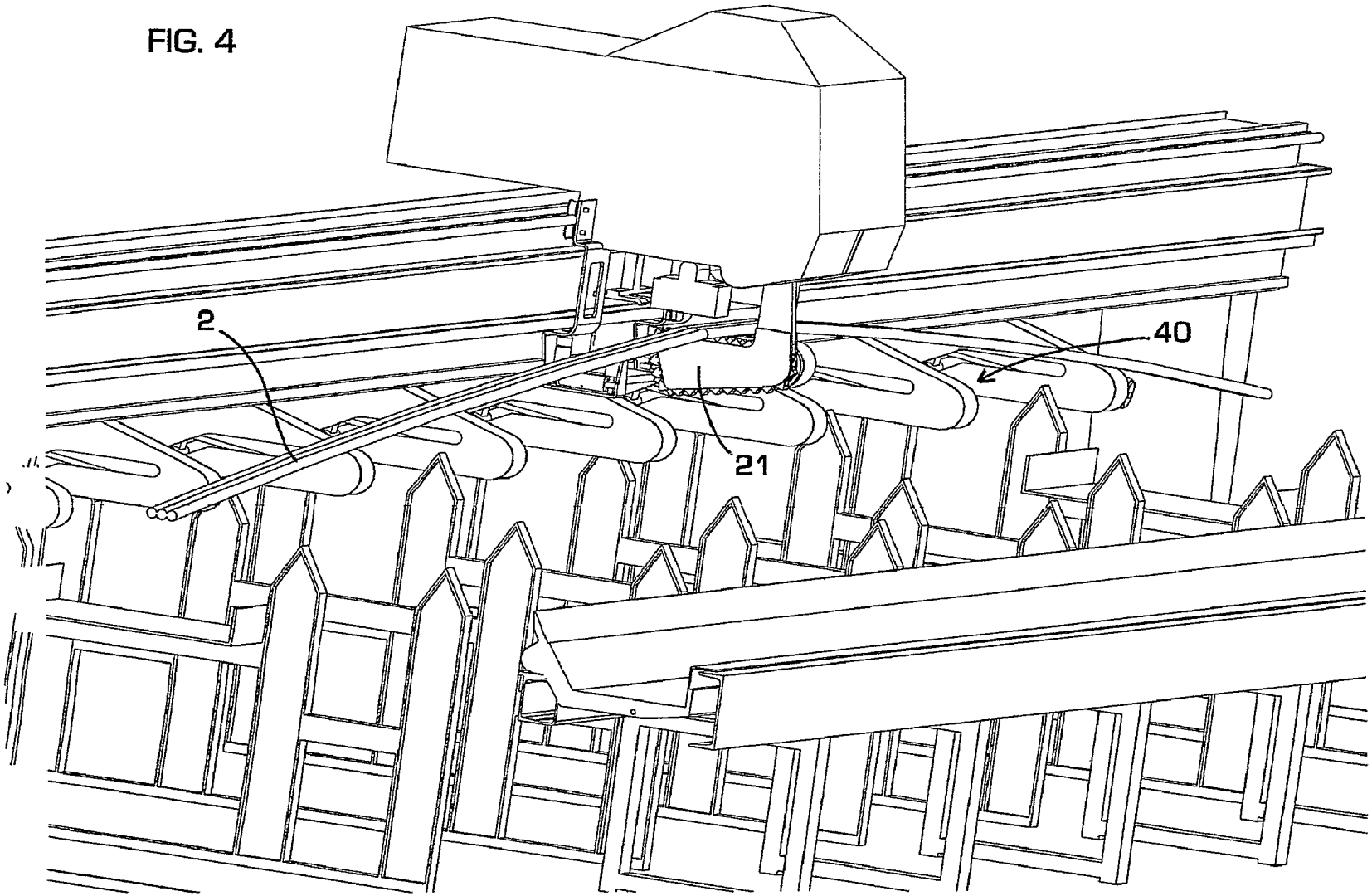
Figure 5:
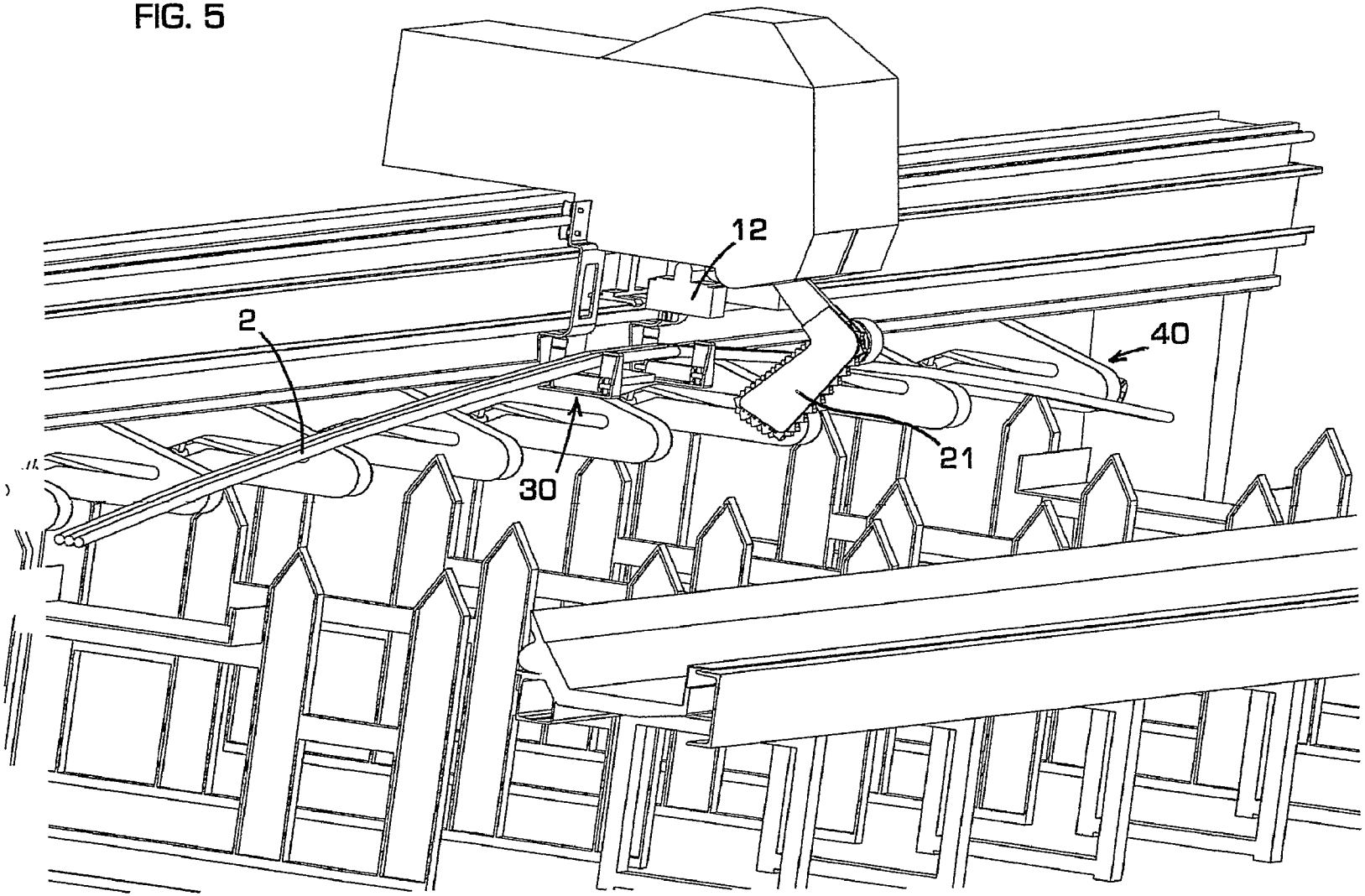

After the lifting of the group of bars 2 by the magnets 12, the tracked tool 21 is rotated angularly to the lifted horizontal position. The bars 2 are then detached from the magnets and dropped on the tracked tool 21 (FIG. 4). The bars 2 released by the magnets 12 settle on the horizontal operative stretch 21*a* of the tracked tool 21, occupying separately the spaces shaped by the segments 24, thus spacing out with regularity. The advancing of the tracked tool 21 driven by the mover 22 causes the transversal transfer of the bars 2 which drop between the rollers of the shuttles 31, placed during such phase besides the transfer device 20 (FIG. 5).

In a preferred embodiment, during the transversal feed phase the counting of the bars 2 is performed, as well, by counting means 14, suitably controlled by specially provided electronic or mechanical means.

Once the first group of bars is transferred, the tracked tool 21 is rotated in the lowered disengaging position, in order to enable the performing of a new seizing cycle for a group of bars 2 by the magnets 12, that are vertically moved in order to take a new group of bars 2 to a lifted position, as previously described. Then, the tracked tool 21 is rotated again to the lifted horizontal position, in order to receive the bars 2 which are subsequently moved in transversal direction and drop on the shuttles 31. During the transversal feed, the counting means 14 operates the counting of the bars 2, in the same way as before.

The described collecting, counting and feeding cycle of the bars 2 on the shuttles 31 is repeated until is reached, or in case exceeded, the requested number of bars. The exceeding bars, if any, can be discharged, during the last counting, inside the storage space 5 of the store 3 from which they are collected, through the rotation of the transfer device 20 to the lowered position.

Figure 6:
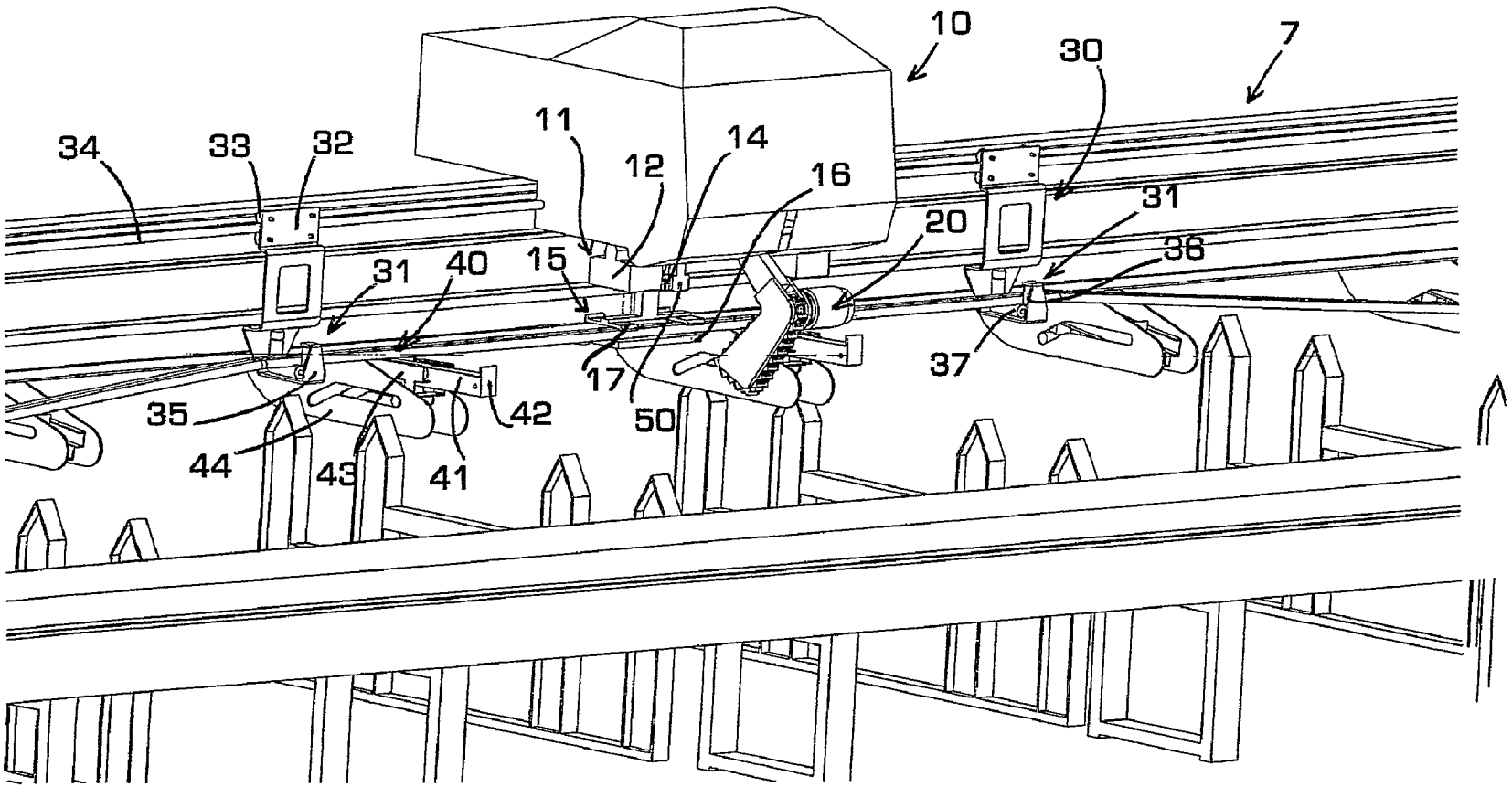

At this point, the central portion of the bars 2 is tightened between the jaws 16, 17 of the tightening tools 15 and, subsequently, the shuttles 31, constrained to the respective carriages 32, slide in opposite directions along the beam-shaped frame 7 (FIG. 6). The tightening of the bars 2 between the jaws 16, 17 aims at preventing that the difference in resistance met during the shifting of the shuttles 31 or at the end of the selected bars 2 forces the bars 2 to move in the direction offering less resistance. The clamp of the tightening tools 15 can be usefully realized so as to enable the simultaneous tightening of bars with different thickness, for instance by means of jaws with sector-shaped profile or jaws provided with an elastically pliable gripping surface, or by means of opposing jaws, suitably staggered, for instance one upper jaw and two lower jaws or vice versa, thus enabling to tighten even bars having different thickness.

The sliding of the shuttles 31 causes the bars 2 to progressively and continuously lift up, which thus disentangle from the bundle lodged in the store below, never slipping from the support of the shuttles 31. During that sliding phase, the bars 2 are laid on the horizontal idle rollers 37 and are borne laterally by the vertical idle rollers 36, thus avoiding any creeping and resulting wear and tear phenomena. The shuttles 31 can also usefully be provided with further horizontal idle rollers, not represented, arranged in parallel below the rollers 37, in order to avoid friction and jamming phenomena due to bars entangled with the collected bars and accidentally lifted from the store 3.

Figure 7:
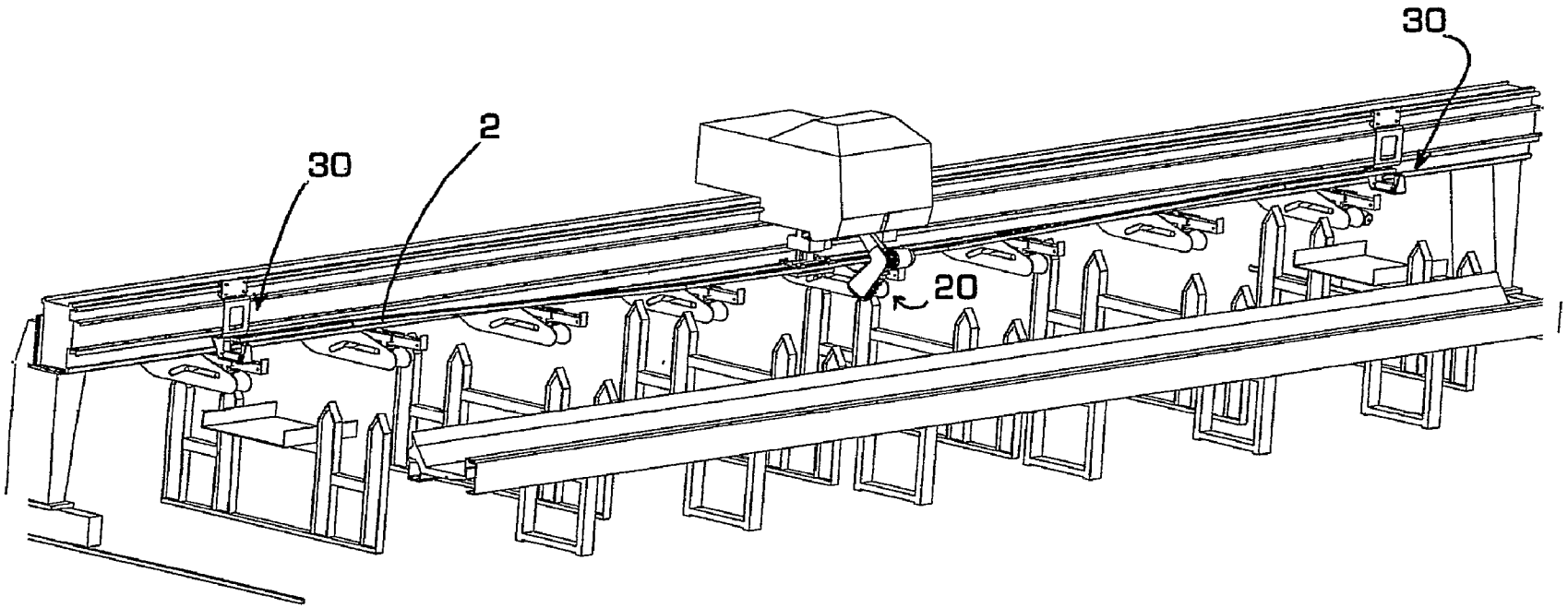
FIGS. 7, 8 and 9 illustrate the aforesaid perspective view of the apparatus in different operational phases.
Figure 8:
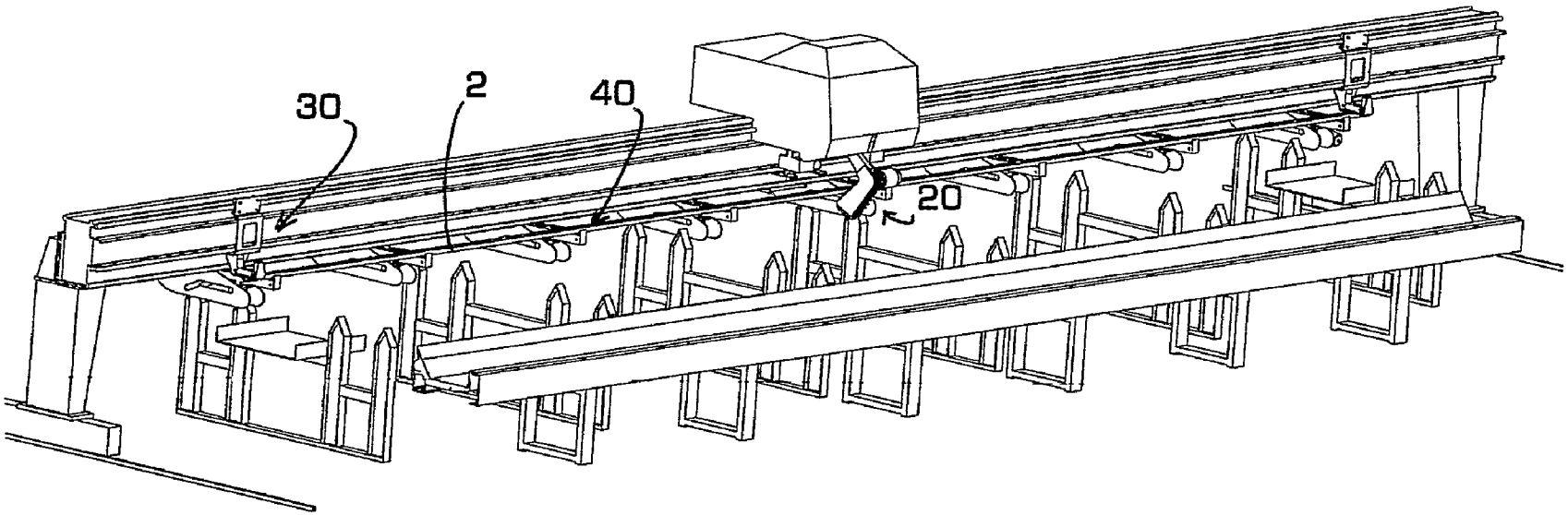

The shuttles 31 reach the discharge position, at the end of the beam-shaped frame 7, where they separate from the bars 2, as having exceeded the length of the bars 2, in order to complete the laying of the bars 2 themselves on the lower retractable arms 41 of the auxiliary supporting devices 40, carried overhanging longitudinally to the beam-shaped frame 7 (FIGS. 7 and 8). During this phase, the retractable arms 41 are arranged in the extracted receiving position for the bars 2. In detail, the arms 41 are preferably set in such extracted position in a progressive way, after the transit of the shuttles 31, from a previous retracted clearing position, suited to avoid any interference with the bars 2 to disentangle.

Figure 9:
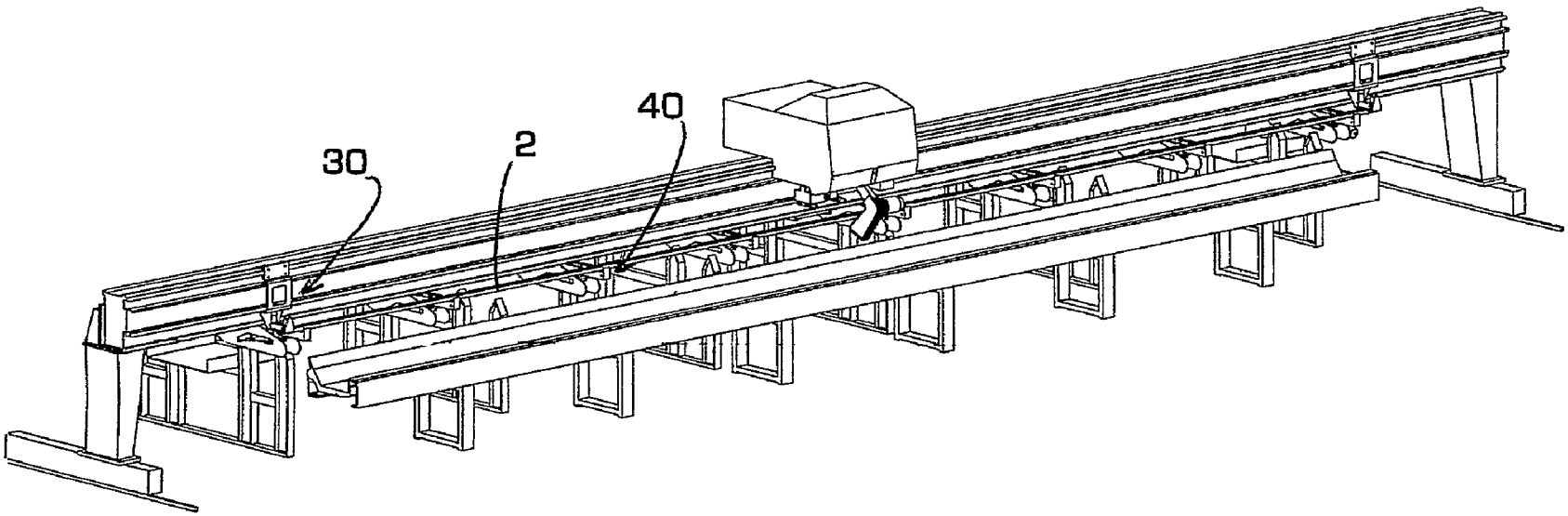
Figure 10:
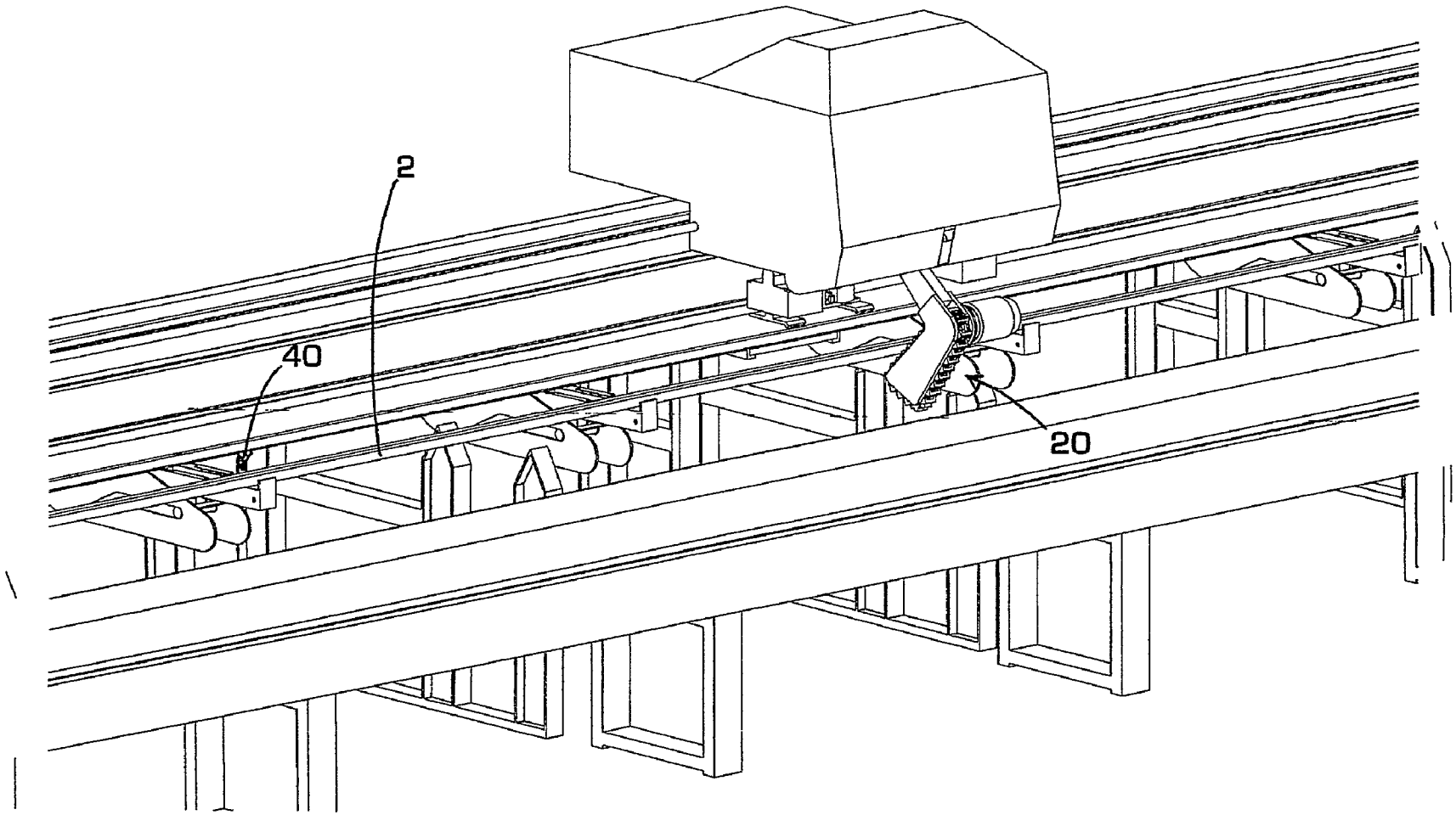
FIGS. 10 and 11 illustrate a perspective view of the aforesaid operational zone of the apparatus in further operational phases.
Figure 11:
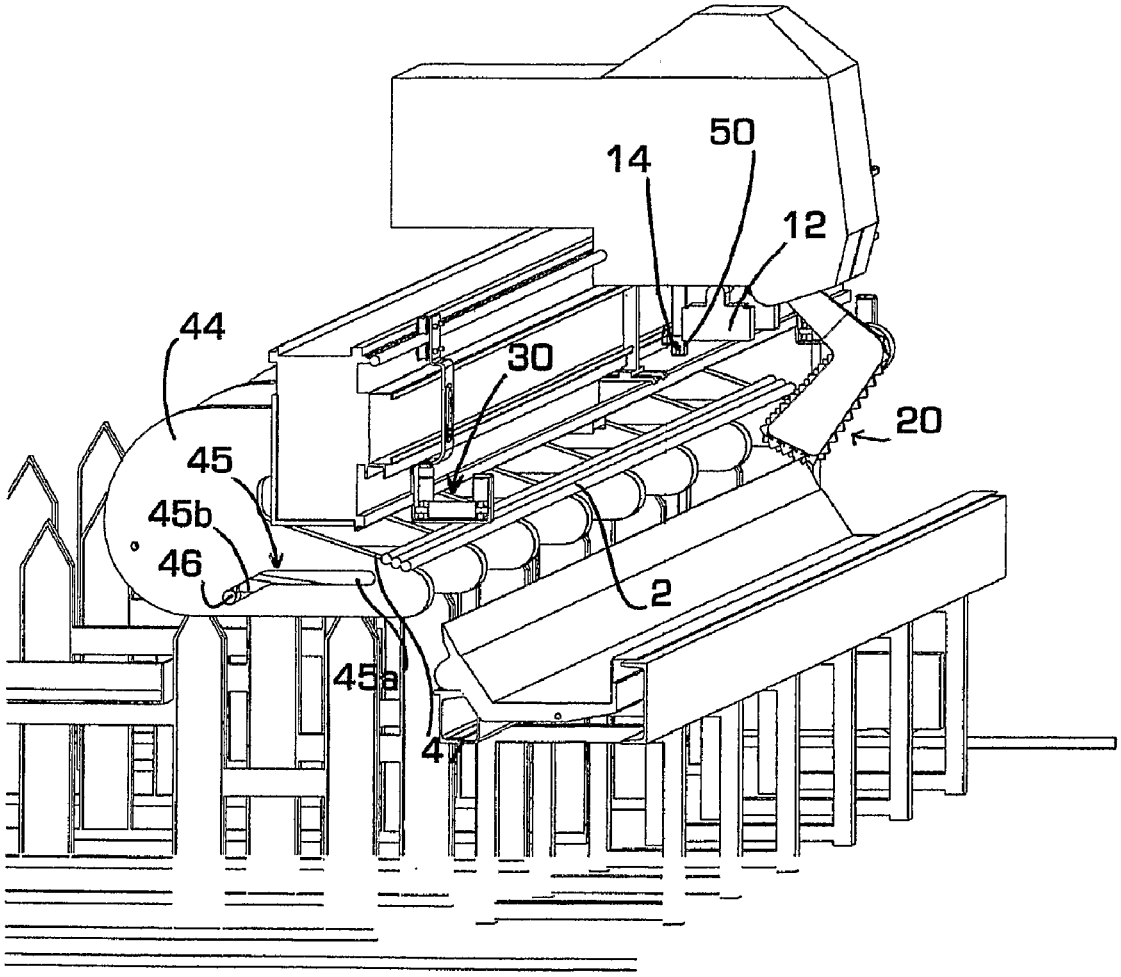
Figure 12:
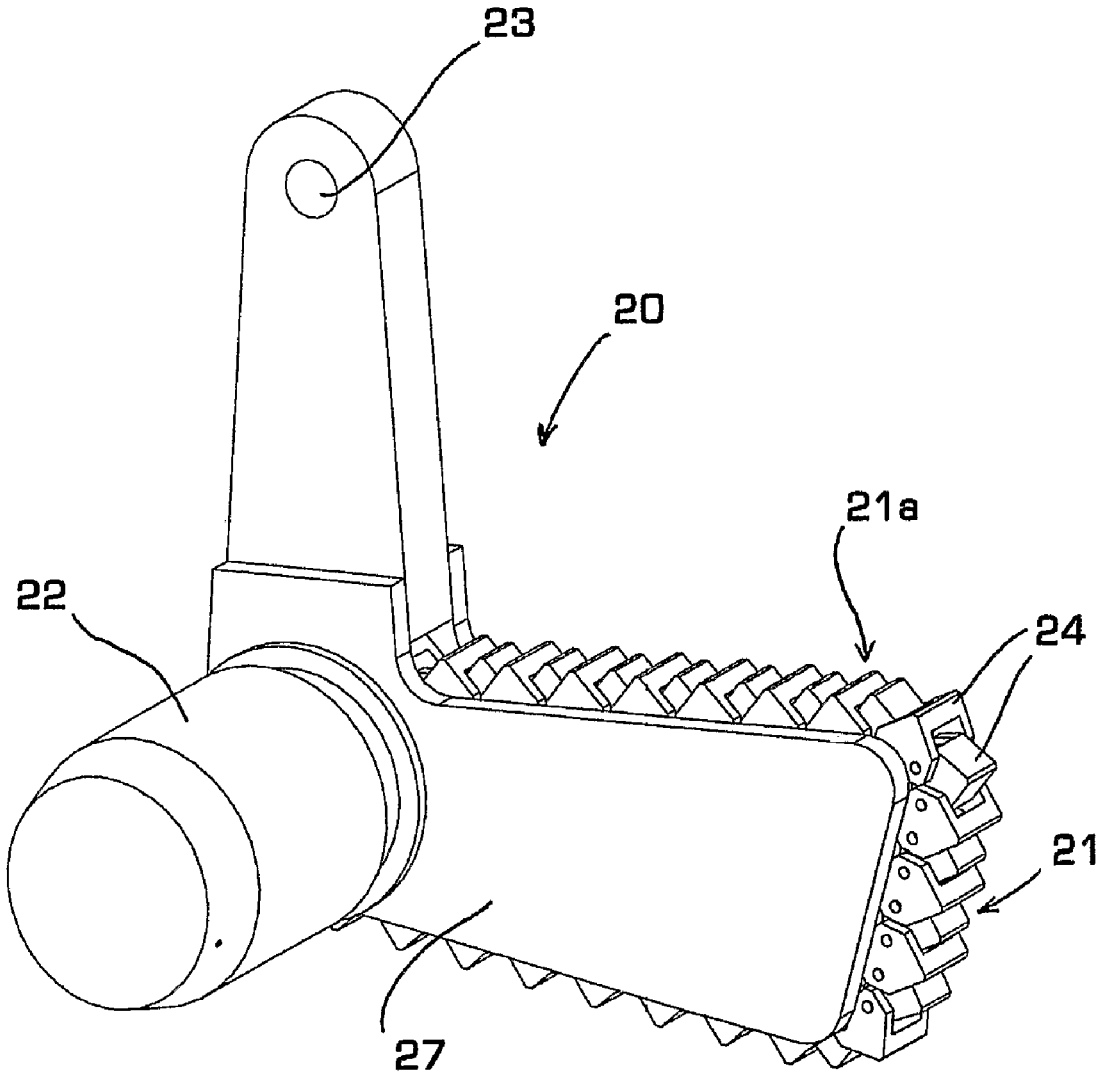
FIG. 12 illustrates a detail view of the transfer device of the apparatus.

Afterwards, the beam-shaped frame 7 is operated to shift over the unloading channel 4 (FIGS. 9 and 10). The retractable arms are then operated in the discharge overturned position. The bars 2, discharged by the retractable arms 41, slide on the upper edge 47 sloped downwards to the walls 44, in order to be conveyed inside the aforesaid unloading channel 4.

According to an alternate embodiment, it is possible to provide that the supporting and shifting function is performed by the shuttles 31 rather than by the aforesaid retractable arms 41. In such case, the shuttles 31 provide for shifting the bars 2 on specially provided receiving devices, as well as for disentangling the bars 2.

According to a different embodiment, it is possible to provide that the counting phase does not take place during the shifting of each group of bars 2 operated by the tracked tool 21, but during the sole final discharge phase of the bars 2 accumulated on the retractable arms 41 and already disentangled by the receiving means 30. To this end, special sensors are provided, able to count the bars 2 stored on the retractable arms 41, when they are operated for the discharge of the bars 2. The phases of lifting, shifting and disentangling the bars 2 are unchanged. Nevertheless, since the bars thus accumulated can result in an excessive number compared with the desired number, the retractable arms 41 are provided, in such case, with special retaining devices suited to retain the exceeding bars 2.

Therefore the claimed method and apparatus reach the aim to carry out in optimum way the automatic feeding of metallic section bars, in particular in plants for the manufacturing of such section bars or for other use, for instance in systems for storing, shifting and fastening selected bundles of bars. That clearly allows to optimize the productivity of such plants, as well as to release operators of an uncomfortable and potentially dangerous task, being removed the need for handling the bars.

A prerogative of the claimed method is the fact that it allows to load the desired number of bars in a very short time, even in case of large-sized bars. The claimed swiftness of the method is valid for every kind and size of bars.

Materials adopted for the actual realization of the invention, as well as their shapes and sizes, can be various, depending on the requirements.

Where technical features mentioned in any claim are followed by reference signs, those reference signs have been included for the sole purpose of increasing the intelligibility of the claims and accordingly such reference signs do not have any limiting effect on the scope of each element identified by way of example by such reference signs.

The invention claimed is:

1. A method for the automatic feeding of metal section bars, the method comprising the steps of:

(a) seizing a group of metal section bars from a store of said section metal bars, by means of gripping tools acting on one or more sections of said metal section bars;

(b) transferring said group of metal section bars to a lifted position;

(c) arranging said group of metal section bars on a transfer device for separating said group of metal section bars;

(d) transferring said group of metal section bars on receiving means;

(e) counting said metal section bars transferred to said receiving means;

(f) repeating steps (a), (b), and (d) until a prefixed number of metal section bars is reached to form collected metal section bars;

(g) disentangling with a single operation said collected metal section bars through progressive sliding of said receiving means along a longitudinal axis of said metal section bars, wherein said step (g) of disentangling said collected metal section bars comprises tightening a substantially central portion of said collected metal section bars between jaws of tightening tools before operating said progressive sliding of the receiving means; and (h) transferring and discharging with a single operation said collected metal section bars in a discharge area.

2. A method according to claim 1, wherein said metal section bars are counted during transfer of each group of metal section bars on said receiving means.

3. A method according to claim 1, a totality of said metal section bars is counted after disentagling the section bars in said single operating phase.

4. A method according to claim 1, wherein a totality of said metal section bars is counted after completing said collecting cycles of said metal section bars.

5. A method according to claim 1, wherein said metal section bars, exceeding in comparison with said prefixed number of metal section bars, are discharged at an end of a last operational collecting cycle of the metal section bars.

6. A method according to claim 1, wherein the metal section bars, exceeding in comparison with said prefixed number of metal section bars, are stored in a pre-storing zone.

7. A method following the claim 1, wherein said metal section bars are seized substantially in a central part thereof.

8. An apparatus for the automatic feeding of metal section bars, the apparatus comprising:

gripping tools for seizing in a cyclical way groups of metal section bars arranged in a store of metal section bars and for transferring said groups of metal section bars in a lifted position;

a transfer device for receiving said groups of metal section bars transferred in said cyclical way by said gripping tools and for separating said metal section bars;

a receiving means for receiving said groups of metal section bars transferred in said cyclical way by said transfer device and for subsequently moving via progressive sliding along a longitudinal axis of said metal section bars to disentangle the said metal section bars collected from said store;

counting tools of said metal section bars transferred on said receiving means, said counting tools determining the reaching of a prefixed number of metal section bars to select;

auxiliary supporting tools for receiving said prefixed number of metal section bars exiting from said receiving means and discharging said prefixed number of metal section bars in a discharge area; and tightening tools for retaining said metal section bars transferred on said receiving means in a substantially central position, wherein said tightening tools comprise a clamp formed by at least a lower jaw constrained to a support frame and at least an upper jaw mobile along a vertical axis, upon control of an actuator.

9. An apparatus according to claim 8, wherein said receiving means is provided with a shuttle at least, constrained to a carriage suited to be set in motion sliding longitudinally to said metal section bars, said shuttle being provided with a plurality of rollers suited to shape a sort of cradle intended for acting as a sliding support for said metal section bars.

10. An apparatus according to claim 9, wherein said rollers comprise a series of horizontal idle rollers and a series of vertical idle rollers for reducing wear and tear phenomena due to creeping of said metal section bars transferred on said receiving means.

11. An apparatus according to claim 10, wherein said shuttle comprises further horizontal fixed idle rollers, arranged in parallel under said horizontal rollers in order to avoid friction and jamming phenomena due to metal section bars accidentally lifted.

12. An apparatus according to claim 9, wherein said shuttle is mobile along a support frame between a receiving position for said metal section bars, substantially beside said transfer device, and a discharge position for said metal section bars, such as to exceed a length of the section bars.

13. An apparatus according to claim 9, wherein said receiving means comprises at least a couple of said shuttles mobile along a support frame, in a suitable phase relationship, in opposite directions, between a receiving position for said metal section bars substantially beside said transfer device, and a discharge position for said metal section bars, such as to exceed a length of the metal section bars.

14. An apparatus according to claim 8, wherein said auxiliary supporting tools comprise retractable arms suited to be operated by respective linear actuators along an axis substantially transverse to said metal section bars between an extracted receiving position of said metal section bars, a retracted clearing position and a discharge position of the metal section bars.

15. An apparatus according to claim 14, wherein a plurality of the said retractable arms are provided in prefixed positions, regularly spaced along a support frame and suited to be operated in a suitable phase relationship by respective actuators.

16. An apparatus according to claim 15, wherein said retractable arms are guided sliding between a couple of opposing walls, fixed to the support frame, showing an edge, sloped downward, on which said metal section bars are intended to slide during the discharge phase.

17. An apparatus according to claim 16, wherein said gripping tools comprise magnetic means carried in motion, along a substantially vertical axis, by an actuator.

18. Apparatus according to claim 9, wherein said transfer device comprises a tracked tool suited to be driven forward by a mover, on a plane transverse to said metal section bars and showing an operative stretch, placed horizontally during an active phase of transfer of said metal section bars on said receiving means.

19. Apparatus according to claim 18, wherein said tracked tool is carried overhanging by an assembly oscillating with alternate motion around an axis, preferably longitudinal to said metal section bars, in order to be revolving between a lifted substantially horizontal working position, during said active phase of transfer of said metal section bars on said receiving means, and a lowered disengaging position, so that tracked tool does not obstruct said metal section bars.

20. An apparatus according to claim 8, further comprising a leveling device, placed above said transfer device and suited to restrict a clearance for the metal section bars in order to avoid undesired overlaps of the metal section bars.

21. An apparatus for the automatic feeding of metal section bars, the apparatus comprising:

gripping tools for seizing in a cyclical way groups of metal section bars arranged in a store of metal section bars and for transferring said groups of metal section bars in a lifted position;

a transfer device for receiving said groups of metal section bars transferred in said cyclical way by said gripping tools and for separating said metal section bars;

a receiving means for receiving said groups of metal section bars transferred in said cyclical way by said transfer device and for subsequently moving via progressive sliding along a longitudinal axis of said metal section bars to disentangle the said metal section bars collected from said store;

counting tools of said metal section bars transferred on said receiving means, said counting tools determining when a prefixed number of metal section bars are selected;

auxiliary supporting tools for receiving said prefixed number of metal section bars exiting from said receiving means and discharging said prefixed number of metal section bars in a discharge area; and tightening tools for retaining said metal section bars transferred on said receiving means in a substantially central position, wherein said tightening tools comprise a clamp formed by at least a lower jaw constrained to a support frame and at least an upper jaw mobile along a vertical axis, upon control of an actuator, wherein said jaws are sector-shaped, in order to tighten metal section bars having different thickness.

22. An apparatus for the automatic feeding of metal section bars, the apparatus comprising:

gripping tools for seizing in a cyclical way groups of metal section bars arranged in a store of metal section bars and for transferring said groups of metal section bars in a lifted position;

a transfer device for receiving said groups of metal section bars transferred in said cyclical way by said gripping tools and for separating said metal section bars;

a receiving means for receiving said groups of metal section bars transferred in said cyclical way by said transfer device and for subsequently moving via progressive sliding along a longitudinal axis of said metal section bars to disentangle the said metal section bars collected from said store;

counting tools of said metal section bars transferred on said receiving means, said counting tools determining when a prefixed number of metal section bars are selected;

auxiliary supporting tools for receiving said prefixed number of metal section bars exiting from said receiving means and discharging said prefixed number of metal section bars in a discharge area; and tightening tools for retaining said metal section bars transferred on said receiving means in a substantially central position, wherein said tightening tools comprise a clamp formed by at least a lower jaw constrained to a support frame and at least an upper jaw mobile along a vertical axis, upon control of an actuator, wherein said jaws comprise respective elastically pliable gripping surfaces for tightening metal section bars having different thickness.

23. An apparatus for the automatic feeding of metal section bars, the apparatus comprising:

gripping tools for seizing in a cyclical way groups of metal section bars arranged in a store of metal section bars and for transferring said groups of metal section bars in a lifted position;

a transfer device for receiving said groups of metal section bars transferred in said cyclical way by said gripping tools and for separating said metal section bars;

a receiving means for receiving said groups of metal section bars transferred in said cyclical way by said transfer device and for subsequently moving via progressive sliding along a longitudinal axis of said metal section bars to disentangle the said metal section bars collected from said store;

counting tools of said metal section bars transferred on said receiving means, said counting tools determining when a prefixed number of metal section bars are selected;

auxiliary supporting tools for receiving said prefixed number of metal section bars exiting from said receiving means and discharging said prefixed number of metal section bars in a discharge area; and tightening tools for retaining said metal section bars transferred on said receiving means in a substantially central position, wherein said tightening tools comprise a clamp formed by at least a lower jaw constrained to a support frame and at least an upper jaw mobile along a vertical axis, upon control of an actuator, wherein said clamp comprises a plurality of opposing jaws, suitably staggered, in order to tighten metal section bars having different thickness.

24. An apparatus for the automatic feeding of metal section bars, the apparatus comprising:

gripping tools for seizing in a cyclical way groups of metal section bars arranged in a store of metal section bars and for transferring said groups of metal section bars in a lifted position;

a transfer device for receiving said groups of metal section bars transferred in said cyclical way by said gripping tools and for separating said metal section bars;

a receiving means for receiving said groups of metal section bars transferred in said cyclical way by said transfer device and for subsequently moving via progressive sliding along a longitudinal axis of said metal section bars to disentangle the said metal section bars collected from said store;

counting tools of said metal section bars transferred on said receiving means, said counting tools determining when a prefixed number of metal section bars are selected;

auxiliary supporting tools for receiving said prefixed number of metal section bars exiting from said receiving means and discharging said prefixed number of metal section bars in a discharge area, wherein said transfer device comprises a tracked tool suited to be driven forward by a mover, on a plane transverse to said metal section bars and showing an operative stretch, placed horizontally during an active phase of transfer of said metal section bars on said receiving means.

25. An apparatus for the automatic feeding of metal section bars, the apparatus comprising:

gripping tools for seizing in a cyclical way groups of metal section bars arranged in a store of metal section bars and for transferring said groups of metal section bars in a lifted position;

a transfer device for receiving said groups of metal section bars transferred in said cyclical way by said gripping tools and for separating said metal section bars;

a receiving means for receiving said groups of metal section bars transferred in said cyclical way by said transfer device and for subsequently moving via progressive sliding along a longitudinal axis of said metal section bars to disentangle the said metal section bars collected from said store;

counting tools of said metal section bars transferred on said receiving means, said counting tools determining when a prefixed number of metal section bars are selected;

auxiliary supporting tools for receiving said prefixed number of metal section bars exiting from said receiving means and discharging said prefixed number of metal section bars in a discharge area, wherein said transfer device comprises a tracked tool suited to be driven forward by a mover, on a plane transverse to said metal section bars and comprising an operative stretch, placed horizontally during an active phase of transfer of said metal section bars on said receiving means, wherein said tracked tool is carried overhanging by an assembly oscillating with alternate motion around an axis, preferably longitudinal to said metal section bars, in order to be revolving between a lifted substantially horizontal working position, during said active phase of transfer of said metal section bars on said receiving means, and a lowered disengaging position, so that tracked tool does not obstruct said metal section bars.

* * * * *